US005576822A

United States Patent [19]

Lindblad et al.

[11] Patent Number: 5,576,822

[45] Date of Patent: Nov. 19, 1996

[54] ULTRASONIC TRANSDUCER FOR BRUSH DETONING ASSIST

[75] Inventors: Nero R. Lindblad, Ontario; David B. Montfort, Penfield, both of N.Y.

[73] Assignee: Xerox Corporation, Stamford, Conn.

[21] Appl. No.: 625,788

[22] Filed: Mar. 29, 1996

Related U.S. Application Data

[63] Continuation of Ser. No. 352,939, Dec. 9, 1994, abandoned.

[51] Int. Cl.[6] ..... G03G 21/00

[52] U.S. Cl. ..... 355/301; 355/296

[58] Field of Search ..... 355/296, 297, 355/301, 302, 303, 215; 15/21.1, 159.1, 256.5, 256.51, 256.52

[56] References Cited

U.S. PATENT DOCUMENTS

| | | | |
|---|---|---|---|
| 4,111,546 | 9/1978 | Maret . | |
| 4,833,503 | 5/1989 | Snelling | 355/259 |
| 4,987,456 | 1/1991 | Snelling et al. | 355/296 X |
| 5,005,054 | 4/1991 | Stokes et al. | 355/296 X |
| 5,010,369 | 4/1991 | Norwak et al. | 355/296 X |
| 5,025,291 | 6/1991 | Norwak et al. | 355/296 X |
| 5,030,999 | 7/1991 | Lindblad et al. | 355/297 |
| 5,065,194 | 11/1991 | Sonnenberg | 355/296 |
| 5,119,144 | 6/1992 | Hada et al. | 355/303 |
| 5,153,658 | 10/1992 | Lundy et al. | 355/301 |
| 5,282,005 | 1/1994 | Norwak et al. | 355/296 X |

*Primary Examiner*—Sandra L. Brase
*Attorney, Agent, or Firm*—T. L. Fair

[57] ABSTRACT

An ultrasonic transducer located under the photoreceptor belt provides vibrational energy to the surface to separate toner particles from the surface. The transducer is positioned such that it is located directly opposite the cleaning nip of the brush cleaner. The transducer reduces the adhesion of the toner to the photoreceptor surface, thereby allowing the brush to operate at reduced interference and voltage. The reduced interference and voltage results in toner being collected only at the very tips of the brush fibers thus, allowing more effective detoning of the brush.

28 Claims, 6 Drawing Sheets

ULTRASONIC TRANSDUCER FOR BRUSH DETONING ASSIST

This is a continuation of application Ser. No. 08/352,939, filed Dec. 9, 1994, now abandoned.

BACKGROUND OF THE INVENTION

This invention relates generally to a cleaning apparatus, and more particularly, concerns an ultrasonic transducer for detoning a cleaner brush.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. Toner particles adhere to the fibers (i.e. bristles) of the brush after the charge retentive surface has been cleaned. The process of removing toner from these types of cleaner brushes can be accomplished in many ways. Typically, brush cleaners, use flicker bars to provide the detoning function. A flicker bar is usually a thin long bar with a controlled amount of interference with the brush fibers. When the fibers encounter the flicker bar, the fibers bend and the impact dislodges toner particles adhering to the fibers. Once released, these particles may be carried away by an airstream to a toner filter or separator. In some electrostatic brush cleaners the toner is removed from the brush with a rotating biased detoning roll. The disadvantage of this method is that as the size of cleaner brushes decrease in diameter, they can not be properly detoned in this manner. This results in partial detoning of the fibers and a gradual accumulation of toner in the brush. When the amount of toner accumulated in the brush exceeds a critical level, a severe cleaning failure can occur.

The following disclosures may be relevant to various aspects of the present invention and may be briefly summarized as follows:

U.S. Pat. No. 5,030,999 to Lindblad et al. discloses a piezoelectric transducer (PZT) device operating at a relatively high frequency coupled to the backside of a somewhat flexible imaging surface to cause localized vibration at a predetermined amplitude, and is positioned in close association with the imaging surface cleaning function, whereby residual toner and debris (hereinafter referred to as simply toner) is fluidized for enhanced electrostatic discharge of the toner and/or imaging surface and released from the mechanical forces adhering the toner to the imaging surface.

U.S. Pat. No. 4,833,503 to Snelling discloses a multicolor printer using a sonic toner release development system to provide either partial or full color copies with minimal degradation of developed toner patterns by subsequent overdevelopment with additional colors and minimal back contamination of developer materials. After developing of the last color image, the composite color image is transferred to a copy sheet. Development is accomplished by vibrating the surface of a toner carrying member and thereby reducing the net force of adhesion of toner to the surface of the toner carrying member.

U.S. Pat. No. 4,111,546 to Maret discloses an electrostatographic reproducing apparatus and process including a system for ultrasonically cleaning residual material from the imaging surface. Ultrasonic vibratory energy is applied to the air space adjacent the imaging surface to excite the air molecules for dislodging the residual material from the imaging surface. Preferably pneumatic cleaning is employed simultaneously with the ultrasonic cleaning. Alternatively a conventional mechanical cleaning system is augmented by localized vibration of the imaging surface at the cleaning station which are provided from behind the imaging surface.

SUMMARY OF INVENTION

Briefly stated, and in accordance with one aspect of the present invention, there is provided an apparatus for cleaning particles from a surface. The apparatus comprises a rotatable brush contacting a side of the surface to form a cleaning nip to remove particles from the surface thereat; and vibrational means located directly opposed from the cleaning nip with the surface being interposed between the rotatable brush and the vibrational means. The vibrational means reduces surface adhesion between the particles and the surface to facilitate removal therefrom by the rotatable brush.

Pursuant to another aspect of the present invention, there is provided a printing machine having means for cleaning particles from a surface. The printing machine comprises a rotatable brush contacting a side of the surface to form a cleaning nip to remove particles from the surface thereat; and vibrational means located directly opposed from the cleaning nip with the surface being interposed between the rotatable brush and the vibrational means. The vibrational means reduces the adhesion between the particles and the surface to facilitate removal therefrom by the rotatable brush.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 7:
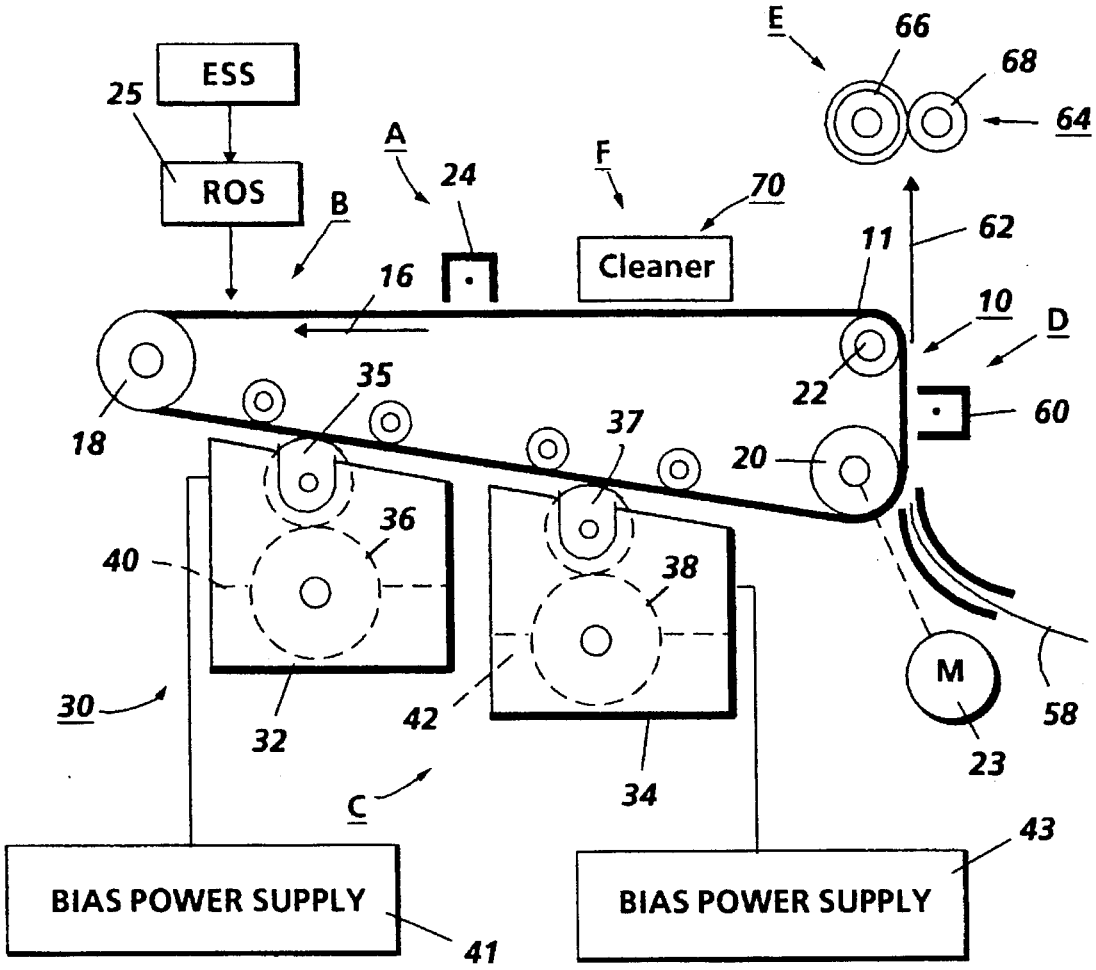
FIG. 7 is a schematic illustration of a printing apparatus incorporating the inventive features of the present invention.

Reference is now made to the drawings where the showings are for the purpose of illustrating a preferred embodiment of the invention and not for limiting same, the various processing stations employed in the electrostatographic machine illustrated in FIG. 7 will be briefly described.

An electrostatographic machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 7, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. This charging has to occur for every color. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two-level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first and second developer apparatuses 32 and 34. (However, this number may increase depending upon the number of colors, i.e. for four colors there would be four developer housings.) The developer apparatus 32 comprises a housing containing a donor roll 35 and a magnetic roller 36. The developer apparatus 34 comprises a housing containing a donor roll 37 and a magnetic roller 38. The magnetic roller 36 develops toner onto donor roll 35. The donor roll 35 then develops the toner onto the imaging surface 11. It is noted that the second development housing 34 and any subsequent development housings must be scavengeless so as not to disturb the image formed by the previous housing. Both housings contain developer material 40, 42 of different selected colors. Electrical biasing is accomplished via power supply 41, electrically connected to developer apparatus 32. A D.C. bias is applied to the rollers 35 and 36 via the power supply 41. Appropriate electrical biasing is accomplished via power supply 43, electrically connected to developer apparatus 34. A D.C. bias is applied to the rollers 37 and 38 via the bias power supply 43.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70. The ultrasonic transducer 160 makes vibrational contact with the under side of the photoreceptive belt 10.

The present invention discloses the use of an ultrasonic cleaning assist (UCA) device (e.g. ultrasonic transducer) to assist in detoning an ESB (i.e. electrostatic brush) or an insulative brush cleaner in addition to assisting in the cleaning of the imaging surface. This is specifically useful in detoning a miniature ESB (i.e. electrostatic brush). Normally, such miniature brushes are 25 mm in diameter, have a weave density of about 80K fibers/in$^2$, and a 7 mm pile height. These brushes can not be detoned properly with a detoning roll 90 due to tight compression of the densely packed fibers 86 against the detoning roll as shown in FIG. 1B. The toner 83 that is not at the tip of the fibers 86 is shielded by other fibers 86 and does not see the detoning roll electric field. This occurs when the "match head" 83 is too long. FIG. 1C shows this detoning step when the "match head" is too long, and only the tip of the fiber is detoned. The accumulation of the toner left on the fiber causes toner to build up in the brush. This results in toner emissions from the cleaner, and cleaning failures.

Figure 3A:
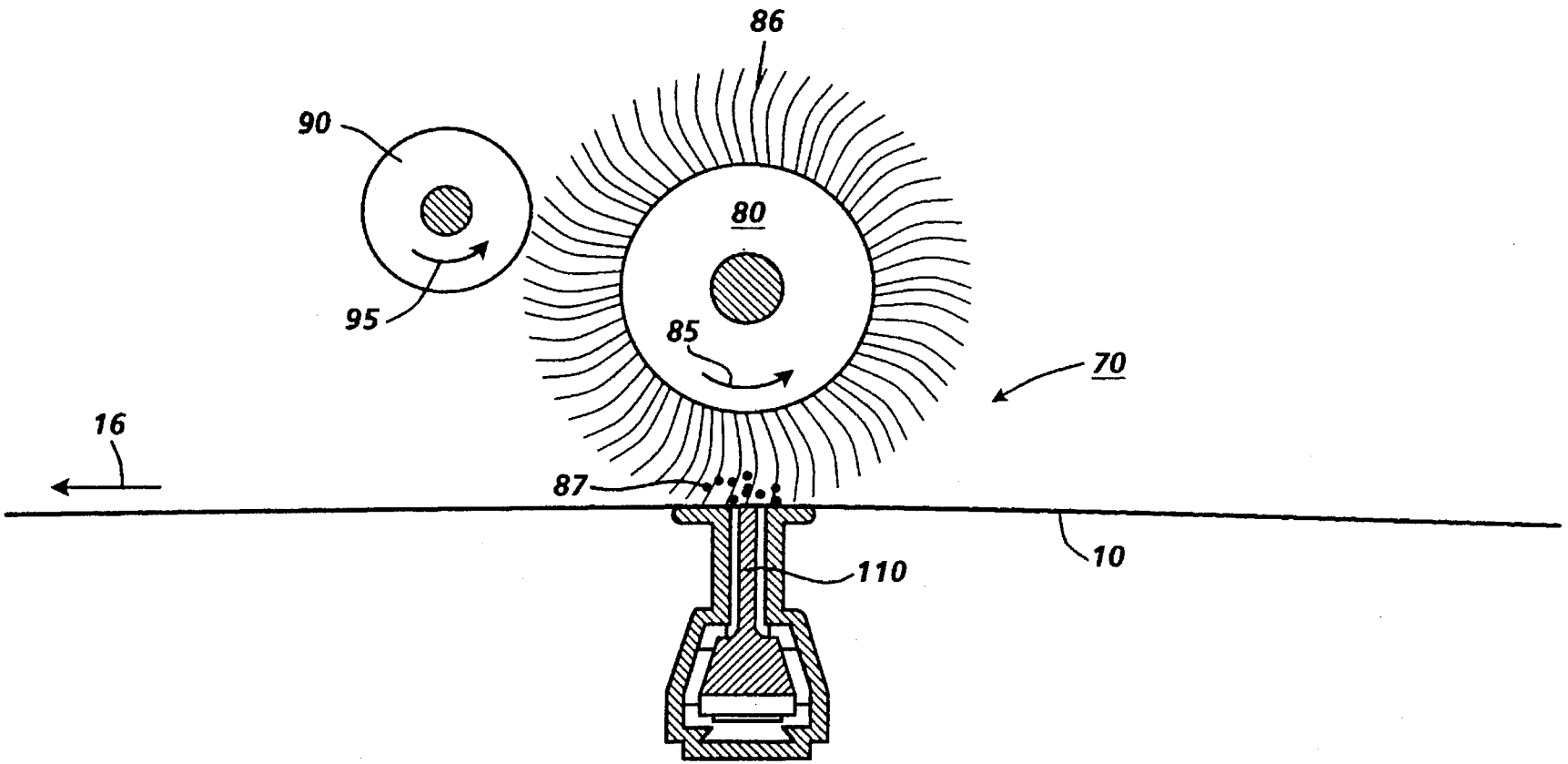
FIG. 3A is a schematic elevational view of the ultrasonic transducer location in the cleaner brush nip.
Figure 3B:
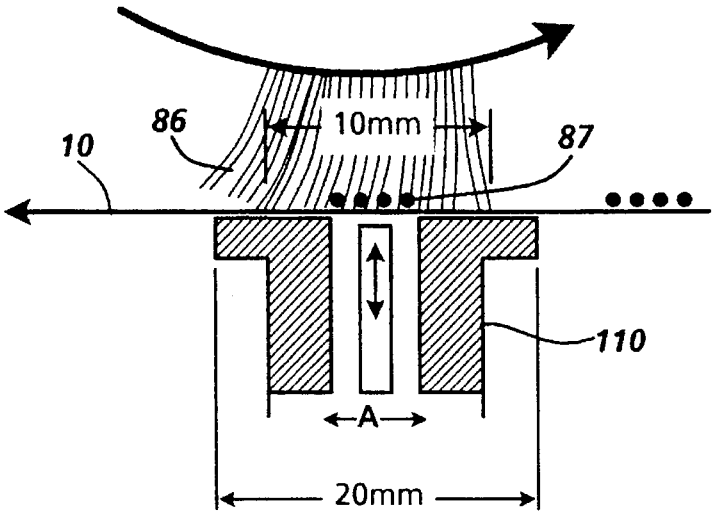
FIG. 3B is an enlarged schematic view of the ultrasonic device in the center of the cleaner brush nip.
Figure 3C:
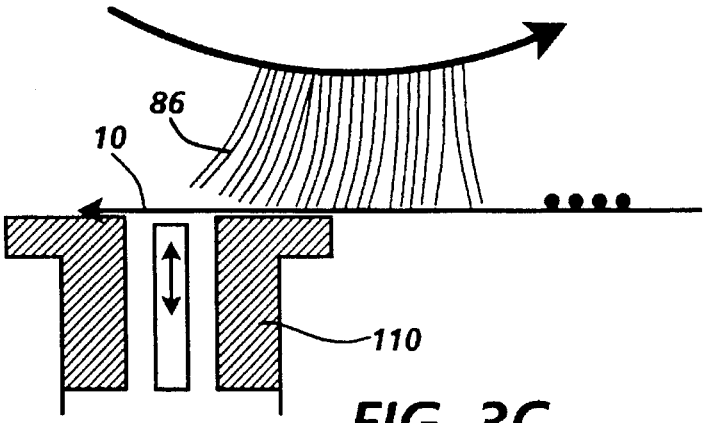
FIG. 3C is a schematic view of the ultrasonic transducer at the post cleaner nip.
Figure 3D:
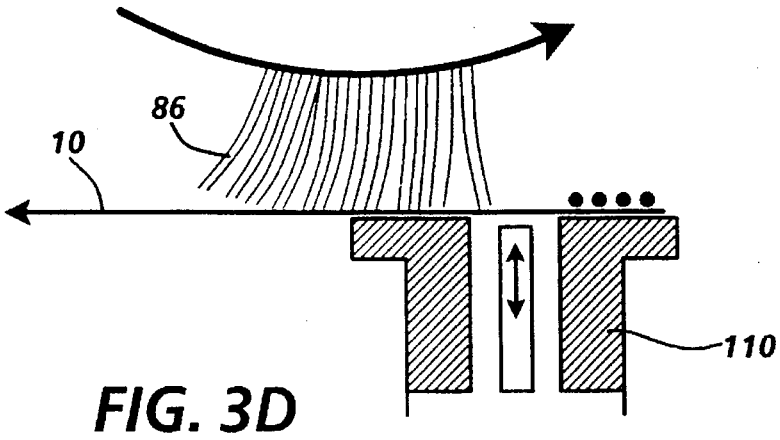
FIG. 3D is a schematic view of the ultrasonic transducer at the prenip of the cleaner.

However, by using an UCA, the size of the "match head" on the fiber is controlled, and emissions from the cleaner and cleaning failures are alleviated. An important part of the effectiveness of the present invention, is the critical location of the UCA device in relation to the cleaner brush. The UCA is placed under the belt in the cleaning nip, as opposed to the prenip or post nip as shown in FIG. 3A. By placing the UCA in the middle of the cleaning nip (see FIG. 3B), as opposed to the prenip, or the post nip as shown in FIGS. 3C and 3D respectively, the toner on the brush fiber is picked up on the very tips of the brush fibers. FIG. 3B shows the UCA in the middle of the cleaning nip. In this case, the toner is levitated in the cleaning nip. Capturing this toner that is levitated on the fiber tips has several important advantages. First, the brush interference with the photoreceptor is less; this reduces the brush set and increases brush life. Second, the brush voltage is less; this aids in reducing the size to the "match head". Third, the brush rpm is less; this reduces toner emissions from the brush. We have found that the width of the active zone (the excitation zone) must be smaller than the cleaning nip width. For example, the active zone should be about half the width of the cleaning nip.

It is important to note that a large area vibrator cannot be placed correctly in the middle of the cleaning nip of a small brush cleaner, i.e., the active zone of a large ultrasonic device is too large extending beyond the cleaning nip 88 of the brush 80. This effect is illustrated in FIGS. 3C and 3D. For example, suppose the ultrasonic device is in the prenip area as shown in FIG. 3D, or the active zone of the ultrasonic device is large and extends into this area. This is an unsatisfactory location because there are no fibers to pick up the charged toner that is levitated momentarily. These toner particles return to the photoreceptor surface and adhere more strongly. This higher adhesion is created by the charge particles rotating and attaching the higher charged region on the toner particles to the photoreceptor. These particles adhere more strongly and cause cleaning failures because the brush cannot clean these toner particles. In the post nip as shown in FIG. 3C most of the excitation field (the active zone) is outside of the cleaning nip. Thus the effect of the UCA is lost.

Figure 1A:
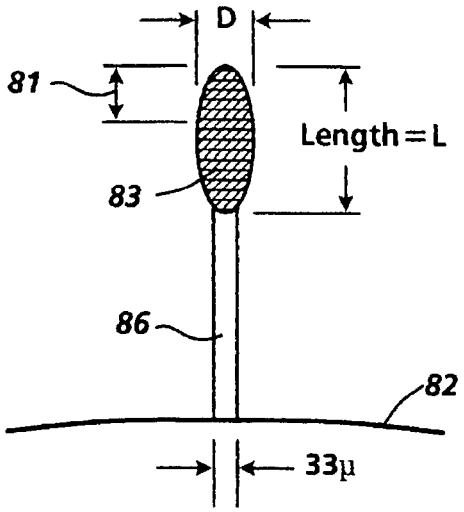
FIG. 1A is a schematic of a cleaner brush fiber showing a typical "match head" of toner on the fiber tip.
Figure 1B:
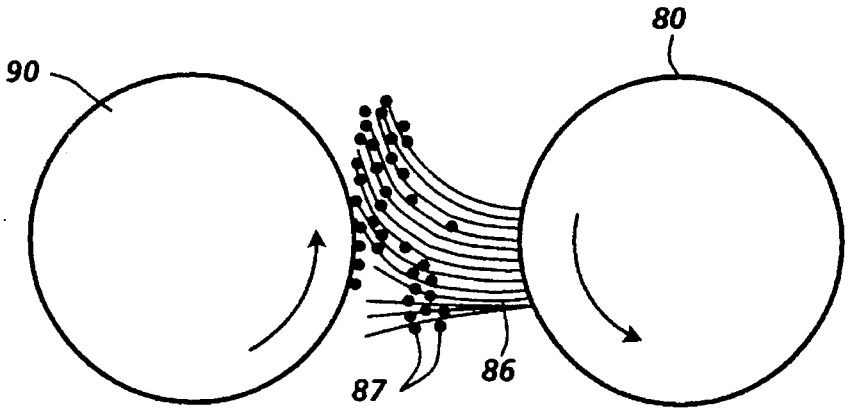
FIG. 1B is a schematic view of the brush fibers interfering with the detoning roll.
Figure 1C:
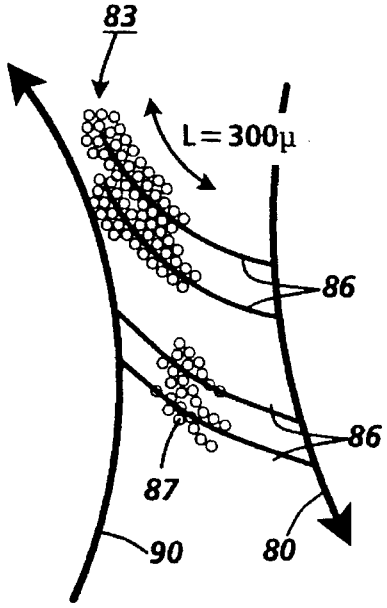
FIG. 1C is a schematic view of brush fibers at the beginning and end of the detoning step.

Reference is now made to FIG. 1A, which shows a schematic of a cleaner brush fiber 86 showing a typical "match head" of toner 83 on the fiber 86. In a miniature ESB cleaner, for example, the brush fibers become loaded with toner during cleaning and cannot be adequately detoned, with a detoning roll, due to the fiber compression that occurs during detoning which tends to trap toner in the fibers (see FIG. 1B). The reason for this is that during cleaning, the toner 83 on the fiber (i.e. match head) does not just build up on the fiber tip 81, but builds upon the fiber 86 towards the core 82 of the brush as shown in FIG. 1C. In a miniature brush with a high density of fibers, the compression of fibers makes it very difficult to remove toner using simply a detoning roll. [An example of the length greater than about 300μ and the diameter is about 90μ of a "match head" that causes difficulty in detoning is shown. A typical brush fiber has a diameter of about 33μ.]

With continued reference to FIG. 1B, when the brush comes into contact with the detoning roll, the brush fibers are compressed and the toner 83 (i.e. in the elongated match head configuration of FIG. 1C) that is not near the fiber tip 81 is not detoned. The toner on the fibers that is not near the tips of the fibers is shielded by the other fibers and does not make contact with the detoning roll field. Under these conditions, the brush fibers gradually load up with toner causing cleaning failures and increasing toner emissions.

Figure 2A:
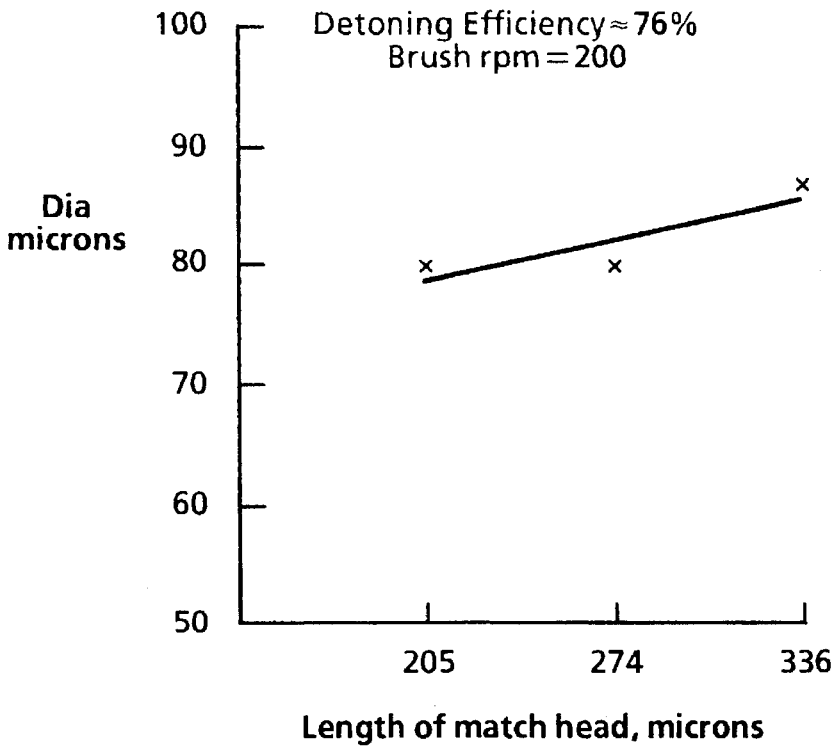
FIGS. 2A and 2B are graphical depictions of the diameter of the "match head" versus the length of the "match head" to show the effects of brush rpm on match head size.
Figure 2B:
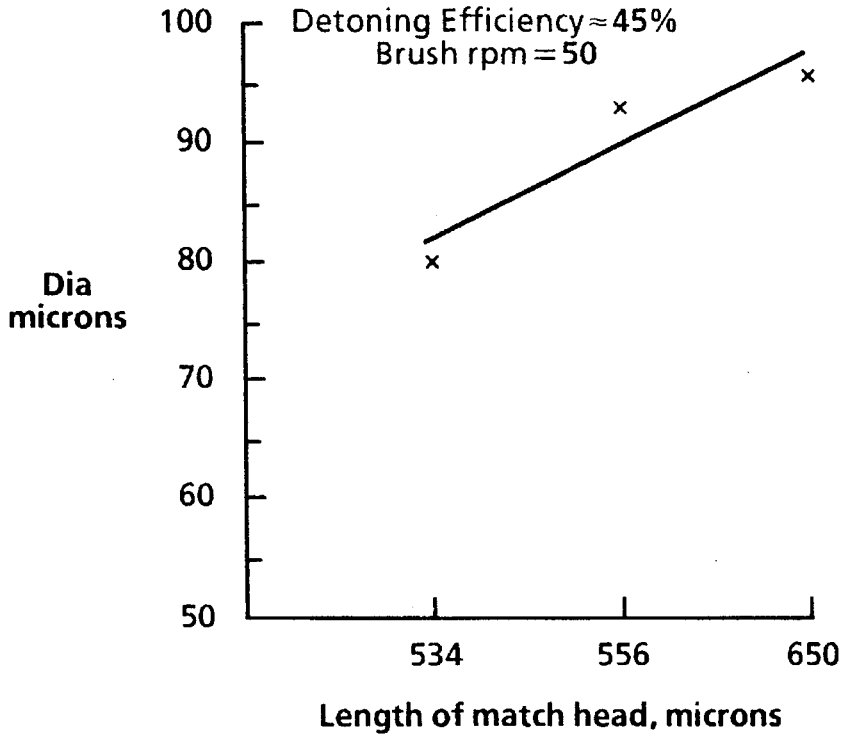
Figure 5:
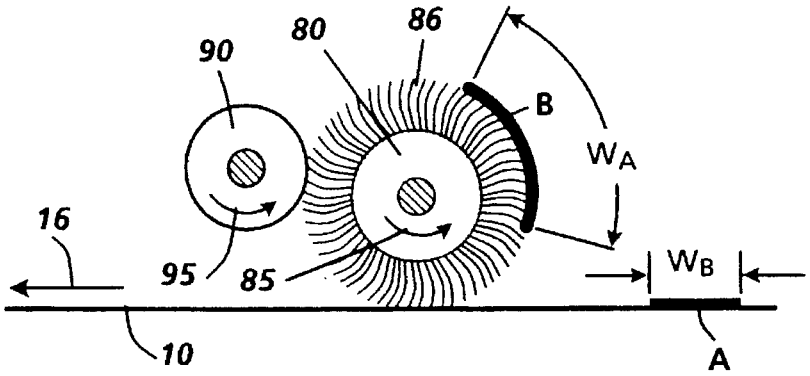
FIG. 5 is a schematic comparing the size of a toner image on the photoreceptor and the toner spread on the brush fibers.

Reference is now made to FIGS. 2A and 2B, which are graphical depictions of the diameter of the "match head" versus the length of the "match head" to show the effects of brush rotational speed (rpm) on match head length for developed mass per unit area (DMA) of 0.40 and without UCA. The smallest "match head" (the smallest L value) is the best and occurs at the highest rpm. Referring now to FIG. 5, the reason that the smallest L values occur at higher speeds is that the toner image A is spread out over the brush fibers 86 as shown by image B on the brush 80. The width $W_B$ of the image B on the brush 80 is typically twice the width $W_A$ of the image A on the photoreceptor 10. This image width on the brush is dependent upon the rotational speed of the brush 80 with respect to the speed of the photoreceptor belt 10. Even with optimized cleaner set points, the toner extends down the fiber (towards the core) too far, and the toner on the fibers is not detoned well enough.

Referring once again to FIGS. 2A and 2B, some examples of the dependency of the detoning efficiency on the "match head" length, and rotational speed of the brush are plotted. FIG. 2A shows a detoning efficiency of 76% at the higher brush rpm of 200, and a shorter match head length of about 275 microns. Whereas, FIG. 2B shows a detoning efficiency of 45% at the lower brush rpm of 50, and a longer "match head" length of about 550 microns. Thus, the shorter "match head" length (shown in FIG. 6) and higher detoning efficiency was achieved by increasing the brush rpm. This is the best that one can achieve for a toner input density to the cleaner of 0.4 mg/cm$^2$ without using the ultrasonic cleaning assist. With the UCA the "match head" length can be decreased to about 100 microns and the detoning efficiency approaches 100%.

Reference is now made to FIG. 3, which shows a schematic elevational view of the ultrasonic transducer 110 location in the cleaner brush nip 88. The purpose of the ultrasonic transducer 110 (or ultrasonic cleaning assist i.e. UCA) in the present invention, is to loosen the toner particles 87 remaining on the photoreceptor 10 during a cleaning cycle, and allow the brush 80, rotating in a counterclockwise direction shown by arrow 85, to remove the airborne toner particles 87, in the cleaning brush nip, by attracting the particles to the brush fiber tips. Thus, allowing the fibers of the brush 80 to clean at a small interference with the photoreceptor 10 and with a low bias voltage.

Figure 4A:
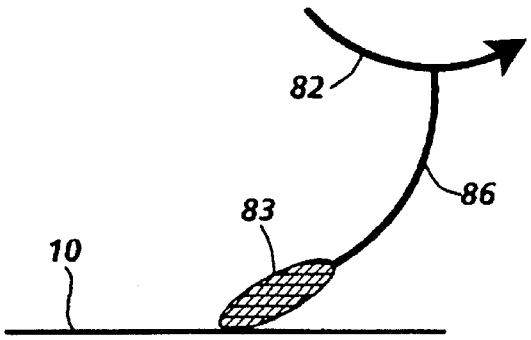
FIG. 4A is a schematic of a typical fiber in interference with the photoreceptor.
Figure 4B:
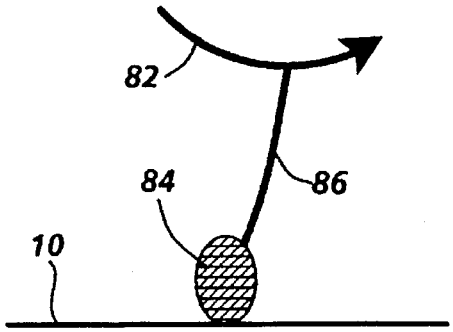
FIG. 4B is a schematic of a brush fiber requiring less interference with the photoreceptor due to the ultrasonic cleaning assist (UCA)

The typical interference of the brush fibers with the imaging surface of the photoreceptor, without an ultrasonic transducer, is about 2 mm. An example of such a brush fiber 86 is shown in FIG. 4A. With the use of an ultrasonic transducer, as in the present invention, the brush fiber/imaging surface interference can be reduced to about 1 mm. An example of such a brush fiber 86 with less interference is shown in FIG. 4B. Ultrasonic enhanced cleaning, properly located, enables reduced brush interference and therefore less fiber (stem) area contact with the photoreceptor 10. (See FIG. 4B). (The interference measurement is the length of the brush fibers extending past the photoreceptor surface if the fibers were straight rather than bent due to contact with the photoreceptor surface.) (It is noted that the interference parameter of approximately 1 mm can be reduced further depending upon the tolerances of the apparatus.)

With reference to FIG. 3A, the ultrasonic transducer 110 is located in the center of the brush cleaning nip, (i.e. not in the post nip nor in the prenip) opposite the brush cleaner 80 making vibrational contact with the under side of the photoreceptor belt 10. (i.e. the brush contact point or nip is directly opposite the transducer tip). This location of the UCA causes the toner picked up by the brush fibers to collect at the very tip of the fibers 86. A detoning roll 90, rotating in the counterclockwise direction shown by arrow 95, removes the toner from the brush fiber tips easily for high detoning efficiency. The transducer parameters such as location and vibrational energy are important because too much vibration can levitate the toner too much, and cause the toner to move too far into the brush. This affects detoning efficiency because now the toner on the fiber tips extends too far down into the fiber. When this occurs the "match head" becomes elongated on the fiber and detoning efficiency is reduced.

Figure 6:
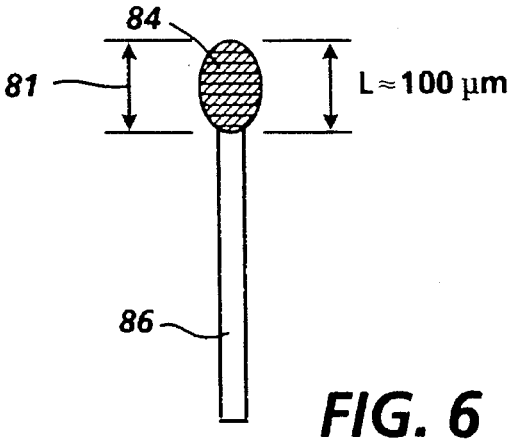
FIG. 6 is a schematic of a "match head" on the brush fiber that occurs with the present invention using an ultrasonic transducer (for easy detoning despite having been compressed in the detoning nip)

With the brush fibers just touching the photoreceptor surface (see FIG. 4B), the airborne toner is captured on the brush fibers creating a small spherically shaped match head, which is desired for efficient detoning of the brush. An example of a "match head" length and diameter that allows for efficient detoning of the brush fiber 86 is about 100 microns as shown in FIG. 6.

Thus, a cleaner with low brush interference and bias voltage becomes viable, with the UCA to loosen the toner on the photoreceptor. Other implications are also possible. If the residual toner after transfer contains a lot of fines (i.e. 2 to 4 microns toners), the UCA will help in the removal of this toner. Also, with less brush to photoreceptor interference, brush set is dramatically reduced. A further benefit of reduced interference is the significant reduction in brush set during on/off cycles. Also, with less interference, photoreceptor drag and abrasion are reduced.

In recapitulation, the present invention describes placing an ultrasonic transducer under the photoreceptor belt. The transducer is positioned such that it is located directly opposite the cleaning nip of the brush cleaner. The transducer reduces the toner to photoreceptor surface adhesion, thereby allowing the brush to operate at reduced interference and voltage. The reduced interference and voltage results in toner being collected only at the very tips of the brush fibers thus, allowing more effective detoning of the brush.

It is therefore apparent, that there has been provided in accordance with the present invention, an ultrasonic transducer for brush detoning assist that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

a rotatable brush having a multiplicity of fibers extending outwardly therefrom contacting a side of the surface and being deflected to form a cleaning region, having a width, to remove particles from the surface thereat, the cleaning region having an active zone therein being smaller in width than the width of said cleaning region to prevent disturbing particles from the surface beyond the cleaning region; and vibrational means located opposed from the cleaning region and having a central axis substantially co-linear with an axis substantially perpendicular to the surface and centrally located in the cleaning region with the surface being interposed between said rotatable brush and said vibrational means, said vibrational means having two adjacent damping members on either side of said central axis to isolate vibration to a narrow area of the surface contacting a central location of the cleaning region, said vibrational means reducing surface adhesion between the particles and the surface to facilitate removal therefrom by said rotatable brush.

2. An apparatus as recited in claim 1, wherein the cleaning region being defined as an area where the fibers of said brush contact the surface.

3. An apparatus as recited in claim 2, wherein said vibrational means contacts a side of the surface opposed from the first mentioned side opposed from said active zone of the cleaning region.

4. An apparatus as recited in claim 3, wherein said active zone comprises approximately one half the width of the cleaning region.

5. An apparatus as recited in claim 4, further comprising a device for detoning said rotatable brush.

6. An apparatus as recited in claim 5, wherein said vibrational means creates vibratory energy to separate the particles from the surface enabling reduced interference between said rotatable brush and the surface.

7. An apparatus as recited in claim 6, wherein said rotatable brush comprises:

a core; and the multiplicity of fibers extending outwardly from said core with the reduced interference being between said fibers and the surface.

8. An apparatus as recited in claim 7, wherein said fibers comprise:

fixed ends coupled to said core; and free ends opposed from the fixed ends, the free ends having fiber tips that contact the surface.

9. An apparatus as recited in claim 8, wherein the reduced interference between said fibers and the surface enable the particles to adhere to said fiber tips for ease of removal during detoning.

10. An apparatus as recited in claim 9, wherein the interference between said fibers and the surface is about 1 mm.

11. An apparatus as recited in claim 10, wherein said vibratory energy enables the particles, being separated from the surface, to be momentarily airborne in the cleaning region, said fiber tips attract the particles thereto.

12. An apparatus as recited in claim 11, wherein said fibers of said brush are electrically biased to attract particles thereto.

13. An apparatus as recited in claim 11, wherein said vibrational means comprises a narrow surface area contacting the surface for localized vibration to avoid uncontrolled separation of the particles from the surface.

14. An apparatus as recited in claim 13, wherein said vibrational means comprises an ultrasonic transducer.

15. A printing machine having means for cleaning particles from a surface, comprising:

a rotatable brush having a multiplicity of fibers extending outwardly therefrom contacting a side of the surface to form a cleaning region, having a width, to remove particles from the surface thereat, said cleaning region having an active zone therein being smaller in width than the width of said cleaning region to prevent disturbing particles from the surface beyond the cleaning region; and vibrational means located opposed from the cleaning region and having a central axis substantially co-linear with an axis substantially perpendicular to the surface and centrally located in the cleaning region with the surface being interposed between said rotatable brush and said vibrational means, said vibrational means having two adjacent damping members on either side of said central axis to isolate vibration to a narrow area of the surface contacting a central location of the cleaning region, said vibrational means reducing surface adhesion between the particles and the surface to facilitate removal therefrom by said rotatable brush.

16. A printing machine as recited in claim 15, wherein the cleaning region being defined as an area where the fibers of said brush contact the surface.

17. A printing machine as recited in claim 16, wherein said vibrational means contacts a side of the surface opposed from the first mentioned side opposed from said active zone of the cleaning region.

18. A printing machine as recited in claim 17, wherein said active zone comprises approximately one half the width of the cleaning region.

19. A printing machine as recited in claim 18, further comprising a device for detoning said rotatable brush.

20. A printing machine as recited in claim 19, wherein said vibrational means creates vibratory energy to separate the particles from the surface enabling reduced interference between said rotatable brush and the surface.

21. A printing machine as recited in claim 20, wherein said rotatable brush comprises:

a core; and the multiplicity of fibers extending outwardly from said core with the reduced interference being between said fibers and the surface.

22. A printing machine as recited in claim 21, wherein said fibers comprise:

fixed ends coupled to said core; and free ends opposed from the fixed ends, the free ends having fiber tips that contact the surface.

23. A printing machine as recited in claim 22, wherein the reduced interference between said fibers and the surface enable the particles to adhere to said fiber tips for ease of removal during detoning.

24. A printing machine as recited in claim 23, wherein the interference between said fibers and the surface is about 1 mm.

25. A printing machine as recited in claim 24, wherein said vibratory energy enables the particles, being separated from the surface, to be momentarily airborne in the cleaning region, said fibers attract the particles thereto.

26. A printing machine as recited in claim 25, wherein said fibers of said brush are electrically biased to attract particles thereto.

27. A printing machine as recited in claim 25, wherein said vibrational means comprises a narrow surface area contacting the surface for localized vibration to avoid uncontrolled separation of the particles from the surface.

28. A printing machine as recited in claim 27, wherein said vibrational means comprises an ultrasonic transducer.

* * * * *